US005816398A

United States Patent [19]

Wang

[11] Patent Number: 5,816,398

[45] Date of Patent: Oct. 6, 1998

[54] PARTITIONED INSERT FOR GOLF BAGS

[76] Inventor: Jessie Li-Kuo Wang, 46980 Ocotillo Ct., Fremont, Calif. 94539

[21] Appl. No.: 835,381

[22] Filed: Apr. 7, 1997

[51] Int. Cl.[6] ..... A63B 55/00

[52] U.S. Cl. ..... 206/315.6; 206/315.3

[58] Field of Search ..... 206/315.2, 315.3, 206/315.5, 315.6

[56] References Cited

U.S. PATENT DOCUMENTS

| | | | |
|---|---|---|---|
| 1,809,536 | 6/1931 | Tucker | 206/315.6 X |
| 2,294,084 | 8/1942 | Gihon, 3rd et al. | 206/315.6 |
| 2,549,055 | 4/1951 | Burton, Jr. | 206/315.6 |
| 2,568,810 | 9/1951 | Kish, Jr. | 206/315.6 |
| 4,420,024 | 12/1983 | Clayton | 206/315.6 X |
| 5,573,112 | 11/1996 | Kim | 206/315.3 X |
| 5,671,843 | 9/1997 | Sutter | 206/315.3 X |

FOREIGN PATENT DOCUMENTS

| | | | |
|---|---|---|---|
| 428118 | 8/1911 | France | 206/315.5 |
| 8333 | of 1911 | United Kingdom | 206/315.5 |

OTHER PUBLICATIONS

Quality Sports, Inc in "Golf Shop Operations", Apr. 1990.

*Primary Examiner*—Sue A. Weaver
*Attorney, Agent, or Firm*—Linval B. Castle

[57] ABSTRACT

A full length insert for golf bags is partitioned into two groups of five compartments along the interior sidewall and four central compartments between the groups. Each of the five groups is fabricated with a single sheet of fabric. The invention may be used of fabricate various forms of inserts for circular, square or oval shaped golf bags.

2 Claims, 3 Drawing Sheets

PARTITIONED INSERT FOR GOLF BAGS

CROSS REFERENCE TO RELATED APPLICATIONS

This application is related to my patent application Ser. No. 08/578,198, filed Dec. 29, 1995, which describes and claims a method for making golf club partitions.

BRIEF SUMMARY OF THE INVENTION

This invention relates to golf club partitions in golf bags and in particular to the method of fabricating full length partitioned inserts that may be placed into an empty golf bag.

Golf bags are generally provided with a few partitions comprising straps across the opening or mouth of the bag for separating the "woods" from the "irons" and the putter. These types of club separators function adequately to separate the heads of the clubs, but they do not adequately protect the club. Only an individual compartment of a soft, non-abrasive material will prevent a constant rubbing together of the shafts and grips resulting in damage to the leather or plastic grips.

Copending patent application Ser. 08/578,198 describes in detail a method for fabricating a particular full length partitioned golf bag insert with fourteen individual full length club compartments. The present invention employs a different method of fabricating the full length partitions and uses fewer components to achieve a partitioned golf bag insert that can be made to fit any shape of golf bag. This invention is not concerned with the method for attaching the insert to the golf bag nor with the use of plastic stiffener sheets around the top of the insert; the invention is for a method for fabricating an insert having compartments that are easy to form and which may be used in a bag having a rectangular, oval as well as circular cross section.

The golf bag insert to be described is made with one sheet of fabric attached at its edges to form an open ended tube. This tube is partitioned into two identical groups of five sidewall compartments with each group comprised of one sheet of folded fabric stitched to the inside surface of the tube. And spanning the area between the two sidewall groups are at lease three smaller strips of the fabric stitched between the fabric folds in the fabric, making a total of fourteen compartments for the maximum number of golf clubs permitted for tournament play.

BRIEF DESCRIPTION OF THE DRAWINGS

In the drawings which illustrate the preferred embodiment of the invention.

DETAILED DESCRIPTION

To adequately protect the shafts and grips of costly modern golf clubs, it is necessary to keep the shafts separated and to keep each shaft and handle in its own compartment formed of a soft non-abrasive fabric extending for the full length of the club shaft. Golf bags are generally made of leather or heavy canvas fabric that is not suitable for partitioning; therefore, for complete, full length partitioning, it is necessary to form a soft fabric liner of thinner material into compartments and insert it into the golf bag.

Figure 1:
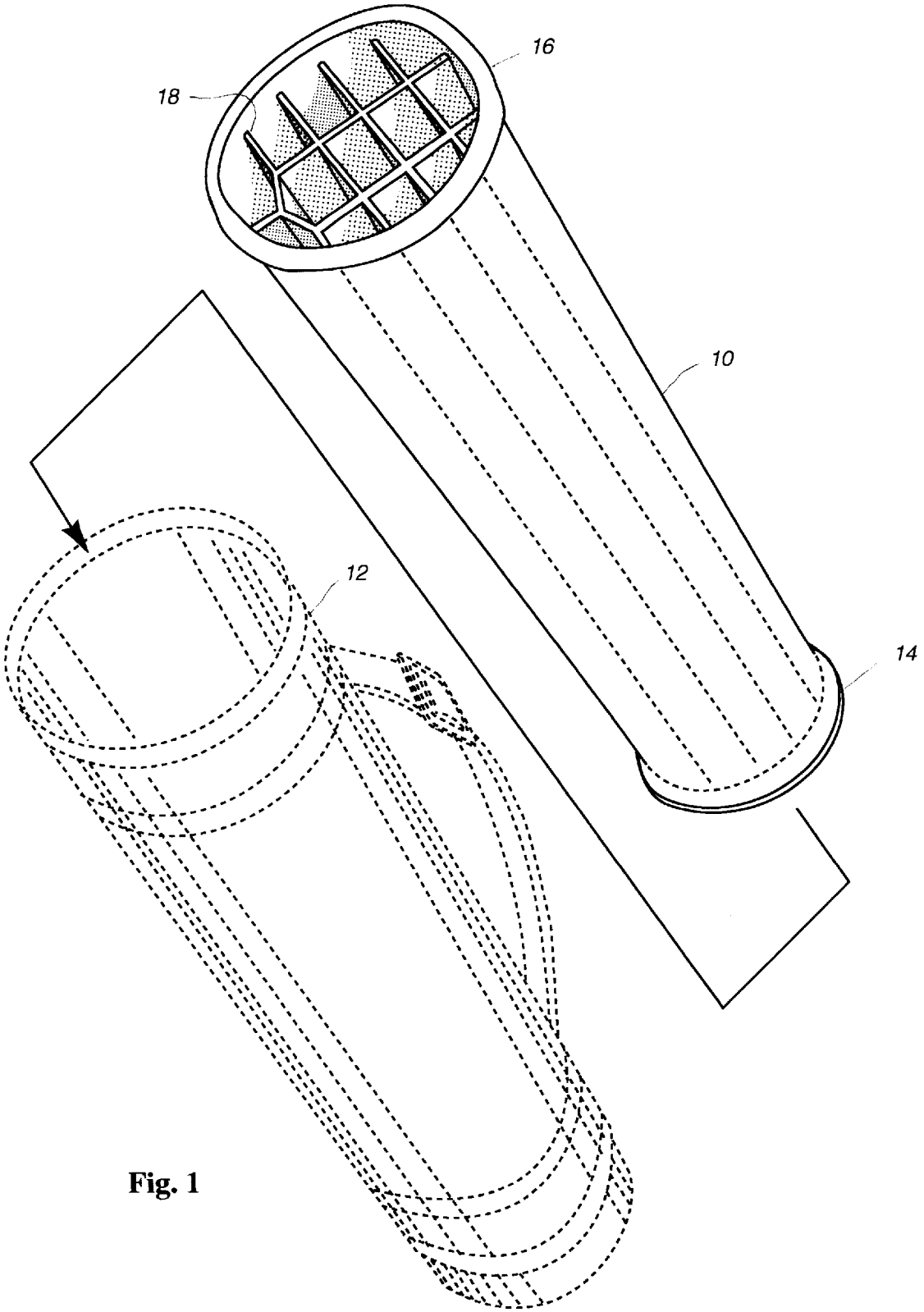
FIG. 1 is a perspective view illustrating a partitioned golf bag insert and, shown by broken lines, a phantom view of a golf bag into which the insert is to be inserted.

FIG. 1 is a perspective view of a golf bag insert 10 and, in broken lines, a typical golf bag 12 into which the insert 10 is to be secured. The insert 10 is made to conform to the inside surfaces of the bag 12 and is therefore tubular with a circular cross section and elongated so that the bottom 14 of the insert lies on the interior bottom of the golf bag. A finishing trim ring 16 of leather of plastic may be sewn around the top of the insert for attaching the insert to the golf bag 12. Approximately an inch below the trim ring 16 are the top edges of the partitions 18 of the insert. An enlarged plan view of the partitions 18 are illustrated in FIG. 2.

Figure 2:
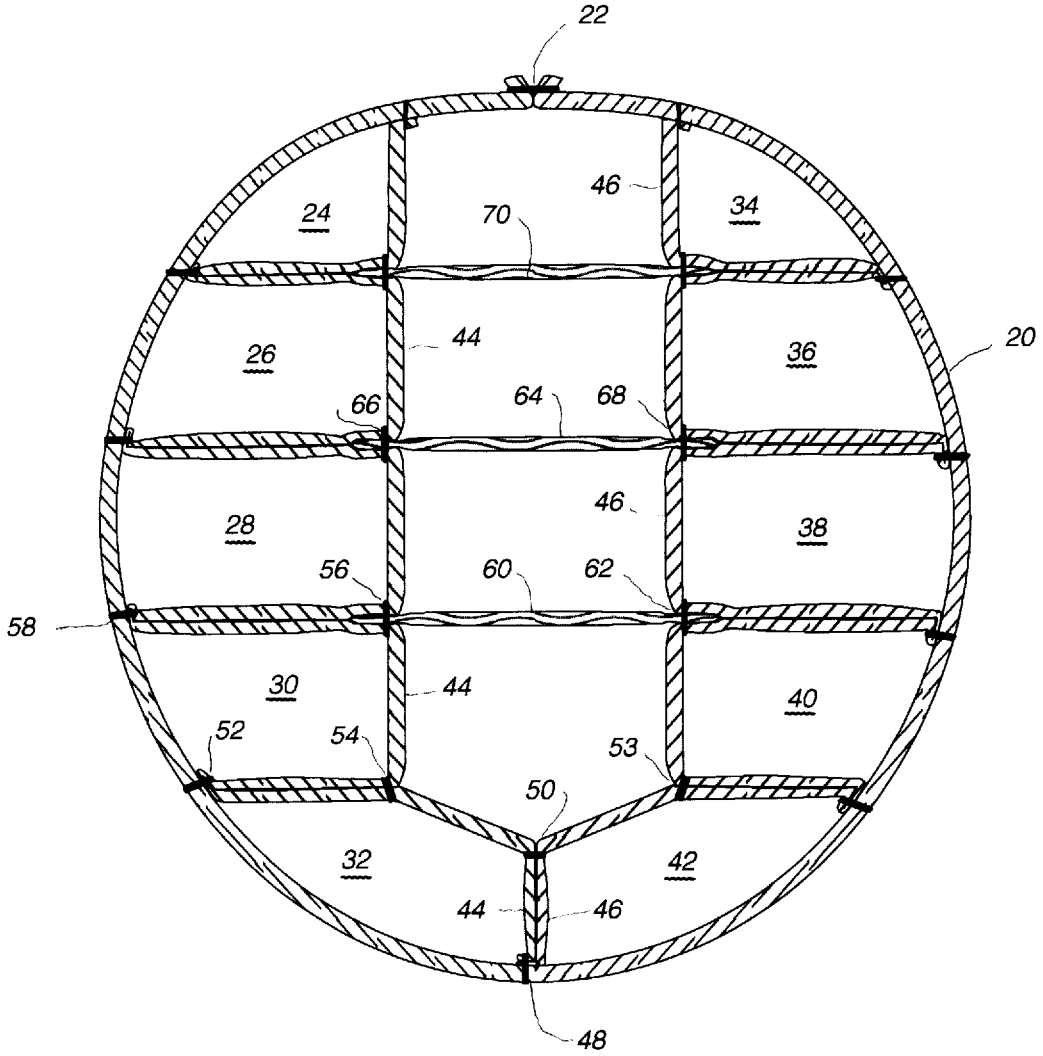
FIG. 2 is an enlarged plan view of the partitioned insert.

FIG. 2 illustrates the fundamental partition pattern of the invention. This pattern is used with golf bags of rectangular cross section as in FIG. 4, with oval cross section as in FIG. 5, and with modifications to some of the central compartments as in FIGS. 6–9. As shown in FIG. 2, the basic partition pattern is comprised of a wide sheet of fabric 20 sewn together at its edges at point 22 to form a tube. Along each sidewall within the tube are five individual compartments, 24, 26, 28, 30, 32 and 34, 36, 38, 40, 42, each using the fabric 20 as one wall. All the other walls of the compartments 24, 26, 28, 32 are formed on one sheet of folded fabric 44, and all the other walls of the compartments 34, 36, 38, 40, 42 are formed with one sheet of folder fabric 46.

The following is a description of the partitions and of the compartments they form; it is not a description of the method of fabrication which will follow.

One end of each of the fabric sheets 44 and 46 is attached to the center 48 of the fabric 20 which has been formed into the tube, and are sewn together at the point 50 to form one common partition for the compartments 32 and 42. From the point 50, the sheets 44 and 46 separate with sheet 44 forming the compartments 24, 26, 28, 30, 32 and sheet 46 form the compartments 34, 36, 38, 40, 42. The partitions forming the compartments 34, 36, 38, 40, 42 are mirror images of those forming compartments 24, 26, 28, 30, 32 and therefore only a description of the parallel partitions of compartments 24, 26, 28, 30, 32 will be described.

If it is assumed that the diameter of the fabric insert 20 is approximately eight inches, then about four inches from the point 50, the sheet 44 is sewn to the sheet at a point 52, approximately ⅓ the distance along the sheet 44 between the point 48 and the edges 22. The sheet 44 is folded at the point 52 and is sewn to itself about two inches from the point 52 at the point 54 to form the compartment 32.

From the point 54 the fabric sheet 44 extends about 1½ inches at a right angle to the point 56 where it again turns at a right angle toward the tubular fabric 20 where the sheet 44 is folded over at the point 58 and brought back to sewn to itself at the point 56 to form the compartment 30.

The same fabric sheet 44 forms compartments 28, 26 and 24 in a similar manner by stitching the fabric 44 to the fabric 20, folding the fabric 44 back and sewing it to itself to form one of the sidewall compartments. Finally, the compartment 24 is formed by merely sewing the end edge of the fabric 44 to the fabric 20 near its edge 22. Identical sidewall compartments 34–42 are fabricated upon the opposite sidewall The area between the two sidewall compartments is conveniently divided by sewing narrow lengths of fabric between the corresponing opposite sidewall compartments.

As illustrated in FIG. 2, a fabric strip 60 is sewn in the fold of the fabric at the point 56 and in the corresponding fold 62 of the fabric 46 in the opposite sidewall to form an compartment enclosed by the sidewall compartments 30 and 40. Similarly, a fabric strip 64 extends between the point 66 in the fabric 44 and point 68 in the fabric 46 to form a compartment enclosed by sidewall compartments 28 and 38. The large remaining central opening is formed into two compartments by sewing the fabric strip 70 into the folds of the fabric sheets 44 and 46, as shown.

Again it is pointed out that the preceding is a description of the invention and not a method for its fabrication. Since the insert has a length that is normally the interior length of a golf bag, the fabrication should be started near the center and leaving the closing of the tubular outer fabric for a final step. Hence, after carefully laying out the golf bag shape and size and the desired compartment sizes, the fabrication should employ the following fabrication steps:

1. Sew the central fabric strips 60, 64, 70 into the folds of the fabric sheets 44, 46 on both sidewalls.
2. Sew together the remaining folds at points 50, 53 and 54 in the sheets 44, 46.
3. In a flat fabric sheet that will become the tubular insert fabric 20, lay out the centerline and attach both edges of the fabric 44 and 46; this will become point 48.
4. Attach remaining folds of sheets 44 and 46 to appropriate points on the fabric 20.
5. Finally, close the fabric sheet 20 at point 22.
6. Sew a fabric disk to cover the open bottom of the insert to prevent the partitions from moving up as golf clubs are being removed.

Figure 3:
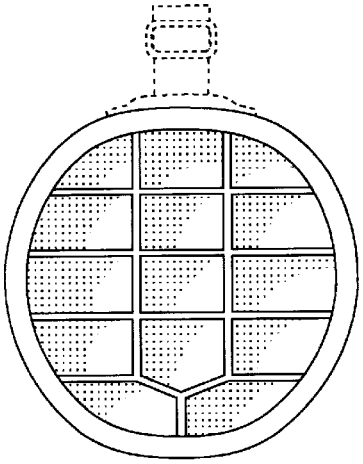
FIGS. 3–9 are plan views of various shaped golf bag inserts with various partitioning that are fabricated using this invention.
Figure 4:
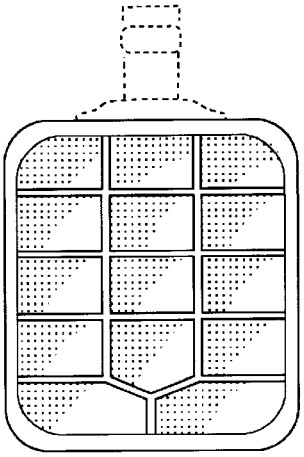
Figure 5:
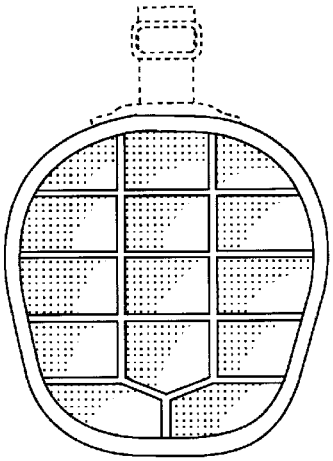

FIGS. 3–9 are plan views illustrating various insert shapes and patterns that can be fabricated using this invention. FIGS. 3–5 are views illustrating the identical insert pattern of the preferred embodiment, FIG. 4 showing it adapted for a golf bag with a square or rectangular cross section and FIG. 5 showing it adapted for an oval configuration.

Figure 6:
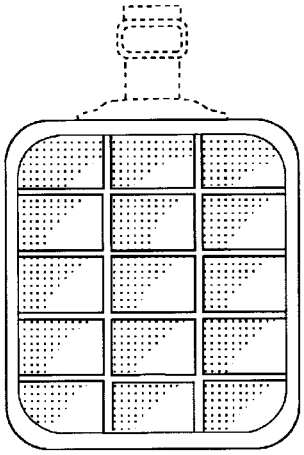

FIG. 6 is a view showing a simple modification resulting in fifteen compartments for a rectangular golf bag. And FIG. 7 illustrates the circular insert of FIG. 3 with an additional vertical partition in the center section that results in a total of sixteen compartments.

Figure 7:
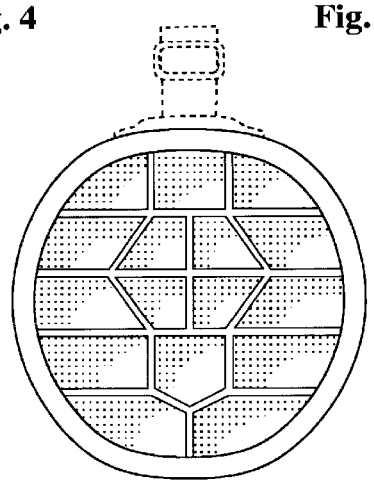
Figure 8:
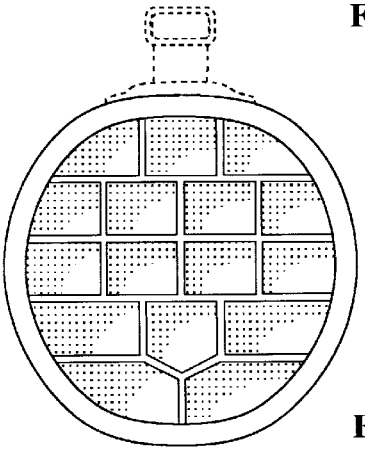
Figure 9:
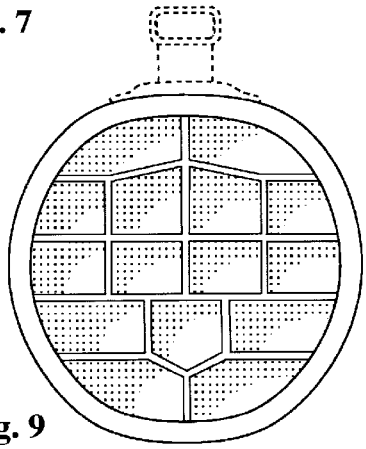

FIG. 8 shows the usual five sidewall compartments on each side of the insert but with the vertical center section inserts of FIG. 7 aligned for a total of sixteen compartments. And FIG. 9 also shows the dual five sidewall compartments rearranged with the central section partitions to form an insert with fifteen compartments.

It should be noted that all of the embodiments illustrated have groups of five sidewall compartments on each side of the insert with each group identically fabricated with a wide sheet of fabric such as the fabric sheets 44 and 46. Other golf club bag insert designs may be made by employing the invention as claimed.

I claim:

1. A full length partitioned insert of fabric for a golf bag comprising:

a fabric tube confirming to the interior of the golf bag, said tube having an interior sidewall with opposite surfaces;

two identical groups of five compartments formed against opposite surfaces of said sidewall, each of said groups being formed with a single sheet of fabric, each said single sheets having two edges and a plurality of folds, said edges and said folds being attached to said sidewall and forming three partitions with parallel sides; and a plurality of strips of fabric each strip having its edge attached between the parallel sides of a corresponding partition on the opposite surface of said sidewall.

2. A full length partitioned insert of soft fabric for golf bags, said insert having two identical interior sidewall groups of five compartments and additional compartments between said sidewall groups, said insert comprising:

a first sheet of fabric having a width corresponding to the inside perimeter of said golf bag, said first sheet having its edges stitched together whereby said first sheet forms a tube;

a pair of second sheets of fabric having equal widths, each sheet in said pair of sheets being folded and formed against said first sheet to become walls of the five sidewall compartments, a first edge of each of said second sheets being secured to a stitched edge of said first sheet, a second edge of each second sheet being secured to an opposite point adjacent the center of said tubular formed first sheet, and at least three third sheets of fabric secured between opposing folds of second sheets, said third sheets forming parallel partitions spanning the central area between the walls of said five sidewall compartments.

* * * * *